US007076819B2

(12) United States Patent
Trani et al.

(10) Patent No.: US 7,076,819 B2
(45) Date of Patent: Jul. 18, 2006

(54) SWADDLE BLANKET

(76) Inventors: Katerina R. Trani, 60 Haskins Ranch Cir., Danville, CA (US) 94506; Sid Trani, 60 Haskins Ranch Cir., Danville, CA (US) 94506

( * ) Notice: Subject to any disclaimer, the term of this patent is extended or adjusted under 35 U.S.C. 154(b) by 0 days.

(21) Appl. No.: 10/956,933

(22) Filed: Sep. 30, 2004

(65) Prior Publication Data

US 2005/0150047 A1 Jul. 14, 2005

Related U.S. Application Data

(60) Provisional application No. 60/508,493, filed on Oct. 2, 2003.

(51) Int. Cl.
*A47G 9/08* (2006.01)
*A47D 15/00* (2006.01)

(52) U.S. Cl. ..... 5/494; 5/482; 2/69.5

(58) Field of Classification Search ..... 5/482, 5/494, 413 R, 655; 2/69.5, 69
See application file for complete search history.

(56) References Cited

U.S. PATENT DOCUMENTS

| | | | | |
|---|---|---|---|---|
| 1,678,125 | A * | 7/1928 | Petrescu | 5/413 R |
| 2,358,410 | A * | 9/1944 | Matthesius | 2/69.5 |
| 5,062,168 | A * | 11/1991 | Kocib | 5/413 R |
| 5,852,827 | A * | 12/1998 | Lear | 2/69.5 |
| 6,662,390 | B1 * | 12/2003 | Berger | 5/486 |
| 6,868,566 | B1 * | 3/2005 | Gatten | 5/494 |

* cited by examiner

*Primary Examiner*—Alexander Grosz
(74) *Attorney, Agent, or Firm*—John P. Wooldridge

(57) ABSTRACT

A swaddling blanket for easily and swiftly swaddling an infant keeps the infant tightly bundled for security and warmth. This blanket helps calm the infant and prevents the infant from being awakened from the startling response. Safety and emotional well-being are thus promoted for both the infant and the parent. The infant looks cute and loveable when wrapped in this blanket. The blanket may be made of cotton fabric material and may be tied or tucked for size and tightness adjustments without the use of added fasteners.

4 Claims, 11 Drawing Sheets

SWADDLE BLANKET

This application claims priority to U.S. Provisional Patent Application Ser. No. 60/508,493, titled "Swaddle Blanket," filed Oct. 2, 2003, incorporated herein by reference.

BACKGROUND OF THE INVENTION

1. Field of the Invention

The present invention relates to infant care products, and more specifically, it relates to an infant swaddle blanket.

2. Description of Related Art

Swaddling is an age-old technique utilized in many countries. It is the art of wrapping an infant in a blanket, snugly for warmth and security, leaving the infant with a sense of well being, as if the infant were still in the mother's womb. It has been experienced and observed by mothers and health care providers that this method of wrapping an infant is soothing and reduces crying, calming the infant and promoting needed sleep. This method also prevents the infant from being awakened by his own startle response, keeps the infant's temperature higher until his own internal thermostat develops and make it safer and easier for the mother to transport the infant, thereby reducing the risk of injury. Due to these multiple advantages, mothers are taught the skill of swaddling before they are sent home from the hospital. Overall, swaddling an infant correctly assists in the transition from the mother's secure, warm and snug womb to a new, colder, alien environment.

A mother with a newborn is typically exhausted from the delivery, increased workload, increased responsibilities and the decrease of valued sleep. Correct swaddling is a skill that requires patience, practice and time to learn. When a newborn cries or suffers colic, a mother's natural response is to quickly soothe and quiet her infant. Trying to swaddle the infant with a receiving blanket while he is crying can be frustrating. It is difficult and time consuming to achieve the desired tight bundle. Once the infant is swaddled, the blanket often quickly becomes loose or unraveled due to transporting the infant or by the infant's own movements. Some babies can turn on their stomachs increasing the risk of suffocation. Swaddling an infant encourages the parent to place the infant on it's back to sleep which helps reduce the risk of Sudden Infant Death Syndrome. Babies that are wrapped in a snug bundle promotes an increase in their emotional well-being as well as the emotional well-being of the parent as it decreases stress that comes from lack of sleep and stress that comes from being in a new environment (such as being outside the mother's womb).

There have been several unsuccessful attempts over many years to create a blanket wrap with the goal of eliminating the above-mentioned problems. Most of these wraps utilized added fasteners such as zippers, Velcro, snaps, pockets and buttons. Each of these fasteners presents problems. For example, the zipper cannot achieve the tightness needed for a secure feeling nor does it allow for needed size adjustments. Velcro is noisy and while attempting to adjust the blanket to infant's size for the needed tight fit, can awaken and startle a sleeping infant, contrary to the desirable aspects of the swaddle method. Velcro does not appear to wear well as infant blankets need frequent washings and Velcro attaching mechanism is reduced with time and use. Pockets are difficult to slide a limp infant into and when wrapped, smaller infants may not fit correctly into the pockets and larger infants may find the pockets restraining their feet. They also appear and function like a straight jacket. Buttons are difficult to fasten when a baby is squirming and crying and require excessive time. They also present a choking hazard to infants if swallowed. Snaps require the use of pressure against an infant's body and do not allow for accurate size adjustment or snug fit. They can also be noisy.

Another problem noted is that other attempts at creating a blanket wrap use too much fabric extension and make it necessary for a parent to roll the infant several times to make the blanket fit. Other blanket wraps use too little fabric, preventing their use for larger infants. Still other blanket wraps use a special cut design that conforms to the infant's body but may become unraveled resulting in baby kicking off the wrap, turning on their tummies and having a risk of suffocation.

Other attempts at creating a blanket wrap fail to use the traditional swaddle method and appearance and do not provide for the needed, extra snug fit around the infant's legs. Some infants want their arms in the blanket and others prefer their arms to be out, e.g., to allow them the additional comfort of sucking their thumb. Blanket wraps already created do not include the option for infants to keep their hands out of the blanket with ease while still allowing for blanket to stay snug.

Some blankets are not designed to conform around the shoulders, use an excessive amount of fabric, are uncomfortable and messy. Another problem noted is that some blankets do not have a slight hammock design that would allow for more space around the bottom and increase comfort. Another problem noted is that other blankets do not have added fabric around and behind the head and neck. The added fabric could increase the sense of security, increase comfort, increase cleanliness as the head does not rest directly on unprotected surfaces or other people's arms or clothing. Another problem noted is that other blanket wraps do not fit babies from premature size to larger sized infants, e.g., up to three months of age. Another problem noted is that other blankets may not use 100% cotton, which is lightweight and natural to prevent infants from overheating.

Receiving blankets require taught skill to achieve the swaddle method, become unraveled with infant movement or transport and are a challenge to swaddle when the infant is crying, which increases frustration for both the infant and the person attempting to swaddle the infant. Other infant wraps use fasteners and/or pockets. Other infant wraps are very expensive. Other infant wraps may require more than one piece. Other wraps have failed to achieve a design that can conform to an infant's body and allow a secure/snug fit without the use of fasteners or pockets. Other wraps do not allow for the option to have the infant's hands out of blanket. Other wraps do not allow for needed size adjustments without the use of added fasteners. Other wraps fail to have the traditional appearance and the traditional method of swaddling and look like straight jackets. Other wraps do not allow for a large variety in one-size fits all that include premature infants. Other wraps do not have added head and neck support. Other wraps are not designed to slightly hammock for increased comfort and appropriately fitting babies body for a non-bulky snug, secure wrap. Other wraps are not designed to taper around infant's shoulders.

There have been several attempts at creating a blanket wrap for infants. The process of swaddling an infant dates back hundreds of years. It is said that Romans, during the Roman Empire, swaddled their infants. Up to date, many attempts have been made to eliminate the problems that a simple rectangular blanket create, however, the attempts, as hopeful and promising as they seem, have failed to solve all of the problems, only touching one or two areas of concern. This is due to design, for it requires the elimination of excess folds, unraveling, loose fit, unsafe use of cords/ribbons, pockets and the use of inconvenient fasteners. The prior art is complicated, does not uniformly hug the infant, are not as fast and are expensive. Because of the expense, complicated design and failure to solve the problems that have been presented for hundreds of years, one fails to see a swaddle blanket sold regularly, as a needed accessory, for every infant, on the market when swaddling has been reported as an infant necessity and can relieve colic, reduce risks of Sudden Infant Death Syndrome and improve the quality of life and emotional well-being of the infant and the parent. A new, affordable, simple and functional swaddle blanket that overcomes the problems presented by the prior art is desirable. The present invention provides such a swaddle blanket.

SUMMARY OF THE INVENTION

It is an object of the present invention to provide a swaddle blanket that helps reduce the risk of Sudden Infant Death Syndrome.

It is another object of the present invention to provide a swaddle blanket that helps stop colic.

Another object of the invention to provide a swaddle blanket that may be used to easily and swiftly swaddle an infant.

Still another object of the invention is to provide a swaddle blanket that utilizes the traditional swaddling method that wraps baby neatly, to keep the infant tightly bundled for security, stay warm during first days of life until infants internal thermostat develops and helps calm the infant and prevents the infant from being disturbed from the startling response.

Another object is to provide a swaddle blanket that does not unravel.

Another object is to simplify and expedite the process of swaddling.

Another object is to provide a swaddle blanket that will conform to the infants shape without adding excessive bulk.

Another object is to provide a swaddle blanket that will fit all babies including premature infants.

Another object is to provide a swaddle blanket that will increase security for baby transport with added head and neck fabric for support and clean infant handling.

These and other objects will be apparent to those skilled in the art based on the disclosure herein.

The present swaddle blanket is made of cotton fabric material and includes options to tie or tuck the fabric allowing for size and tightness adjustments without the blanket becoming loose or falling apart and without the use of added fasteners. The blanket is spread and the infant is placed in the center of the blanket, on his back, with the crown of the head touching the top surface. One corner is pulled diagonally, across the body having extra fabric length to allow the leading edge to be tucked under the infant's lower back or bottom. The opening between the two fabrics were the wings and flaps can be tucked under baby's lower back or bottom is one of the key component to the invention as this allows for fabric tension and baby's weight to keep wrap snug and secure to prevent unraveling. The bottom panel, which has extra fabric length for needed size adjustments, is pulled up towards the infant's chest and folded as needed to adjust for size. The opposite corner is pulled diagonally, across the infant's body, and also has extra fabric length so that it can be tucked behind the infant into a provided area to keep the blanket in place. The two remaining flaps of fabric are used to tie or tuck the swaddle blanket in place to further prevent the blanket from unraveling and keep the infant's legs secure. The blanket and its method of use allows for the infant's hands to remain in or out of the blanket. Extra fabric length is used only in areas needed to secure the infant and to allow for a neat wrap that is not bulky and hugs the baby.

BRIEF DESCRIPTION OF THE DRAWINGS

The accompanying drawings, which are incorporated into and form part of this disclosure, illustrate embodiments of the invention and together with the description, serve to explain the principles of the invention.

DETAILED DESCRIPTION OF THE INVENTION

Figure 1:
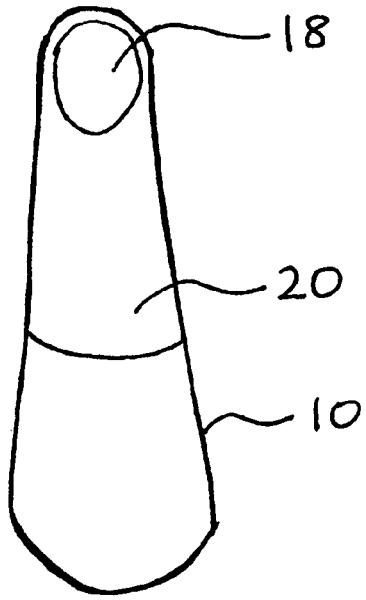
FIG. 1 shows section one.

Referring to FIG. 1, Section One (10) is the centerpiece of present invention with a "tie" shaped fabric made for resting an infant's head (at 18) and body (at 20). The lower end of Section One (22) is folded upwards to cover the infant's legs while being wrapped. Section One can be one or two layers of fabric and is sewn to Section 2 and Section 3 from both sides.

Figure 2:
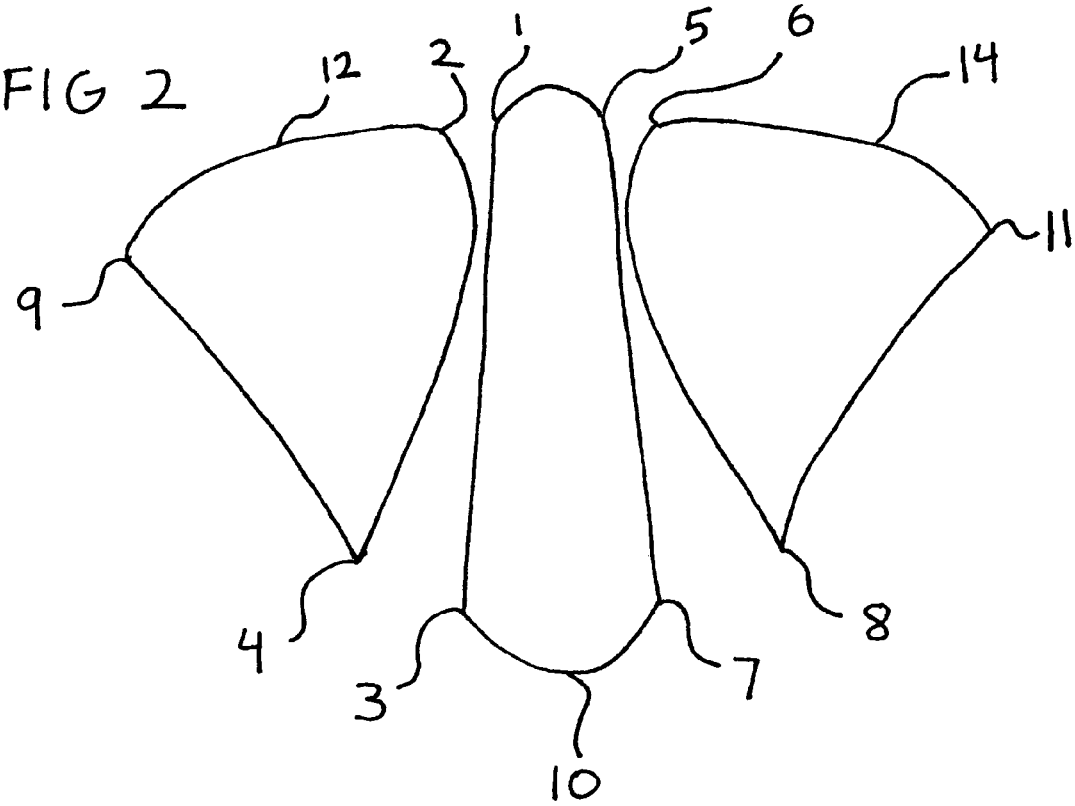
FIG. 2 shows sections one through three.

Referring to FIG. 2, Section Two (12) and Section Three (14) are "wing" like shaped fabric (single or double fabric), curved on one side, and are sewn to Section One on each side. The following areas are sown together: 1 to 2, 3 to 4, 5 to 6 and 7 to 8. In one embodiment, as discussed below, the entire length of fabric from point 1 to point 3 is not sewn to Section Two, leaving an opening for the end of Section Three to be tucked behind Section One. Similarly, in one embodiment, as discussed below, the entire length of fabric from point 5 to point 7 is not sewn to Section Three, leaving an opening for the end of Section Two to be tucked behind Section One. The curves will create a "hammock" like shape for extra space to hold and secure the infant's shoulders. These wings are made to wrap around the infant's body and support the infant's headrest area of Section One and support the infant's neck.

Figure 3:
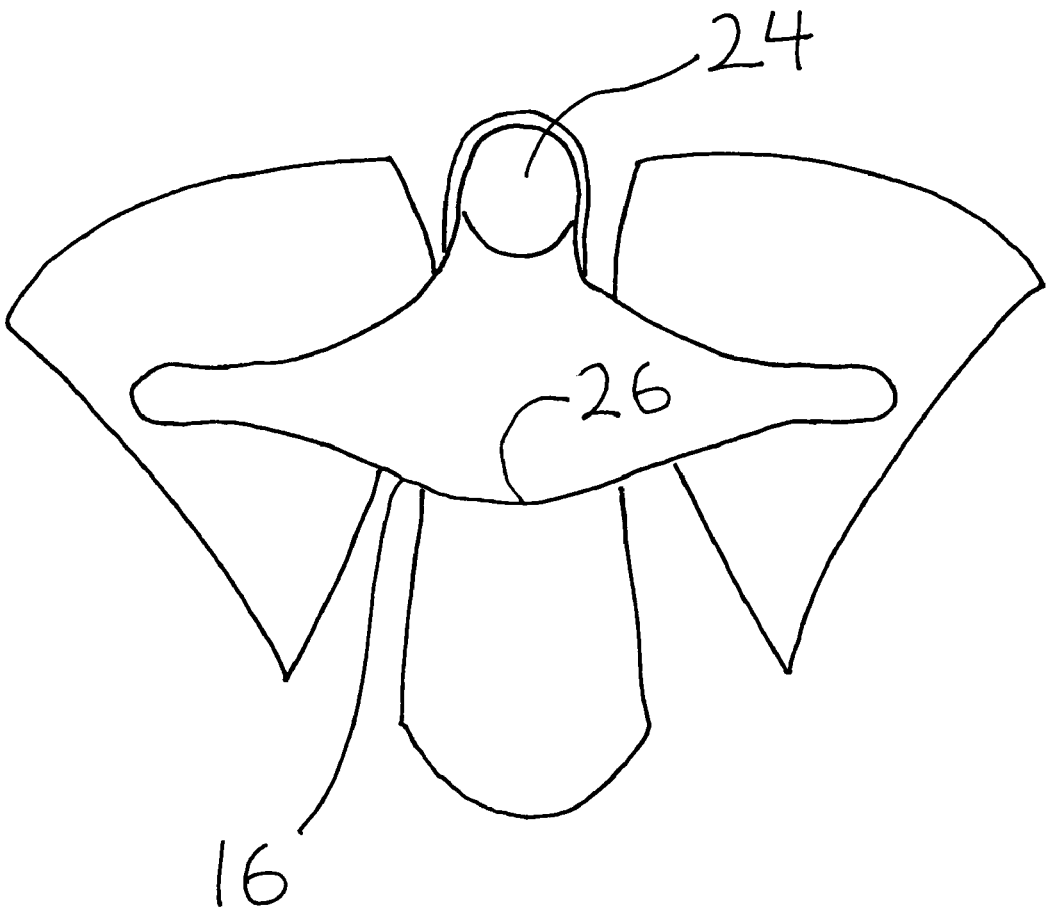
FIG. 3 shows sections one through four.

Referring to FIG. 3, Section Four (16) is a single or double fabric sewn on the back of Section One using an oval at the headrest area 24 and a crescent shape at the lower portion 26. In an embodiment, as discussed above, the area between 24 and 26 remains unsown in order to tuck excess winged fabric (Section Two and Section Three). This allows for wrapping an infant without use of fasteners, holes, buttons, Velcro or pockets. The end of the wing (Section Two and Section Three) are held in place by the infant's weight and the tension created by tying or tucking which is done by using the two ends of Section Four. Section Four also functions as cushioning under the infant's head and body, while also providing extra support for the infant's neck, shoulders and back, while holding the infant's legs. This prevents the blanket from opening or falling apart by allowing the infant's parent to tie or tuck blanket in place. The two ends of this section are made to be functional without use of fasteners or buttons, which allows for one size to fit all.

Ends of Section Four are designed to hold the blanket in place and keep distance from infant's neck and chest area for added safety and comfort. These ends are shortened to prevent a choking hazard while at same time long enough to be tied.

Figure 4:
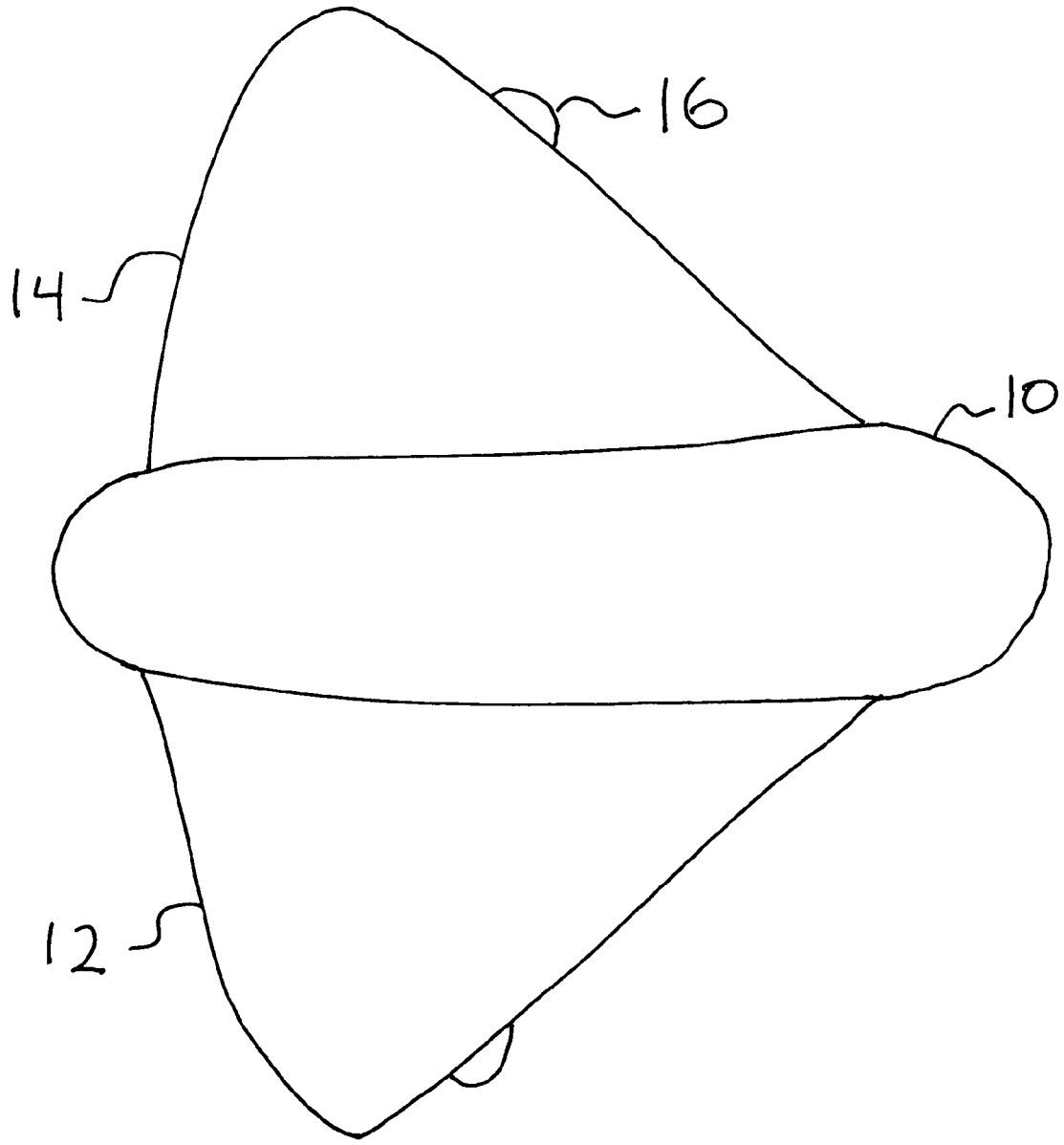
FIG. 4 is front view of the blanket.
Figure 5:
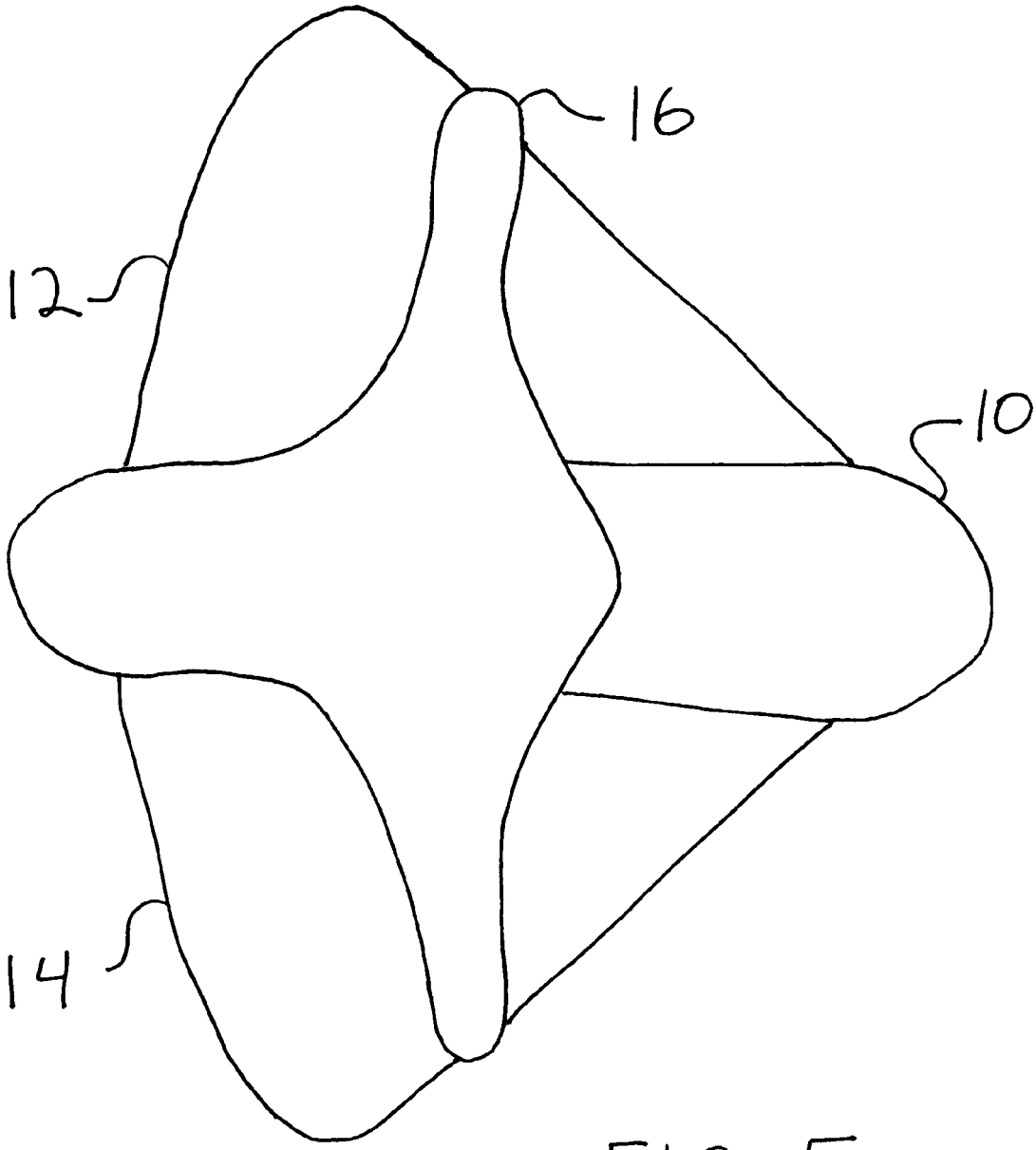
FIG. 5 is a back perspective view of the blanket.
Figure 6:
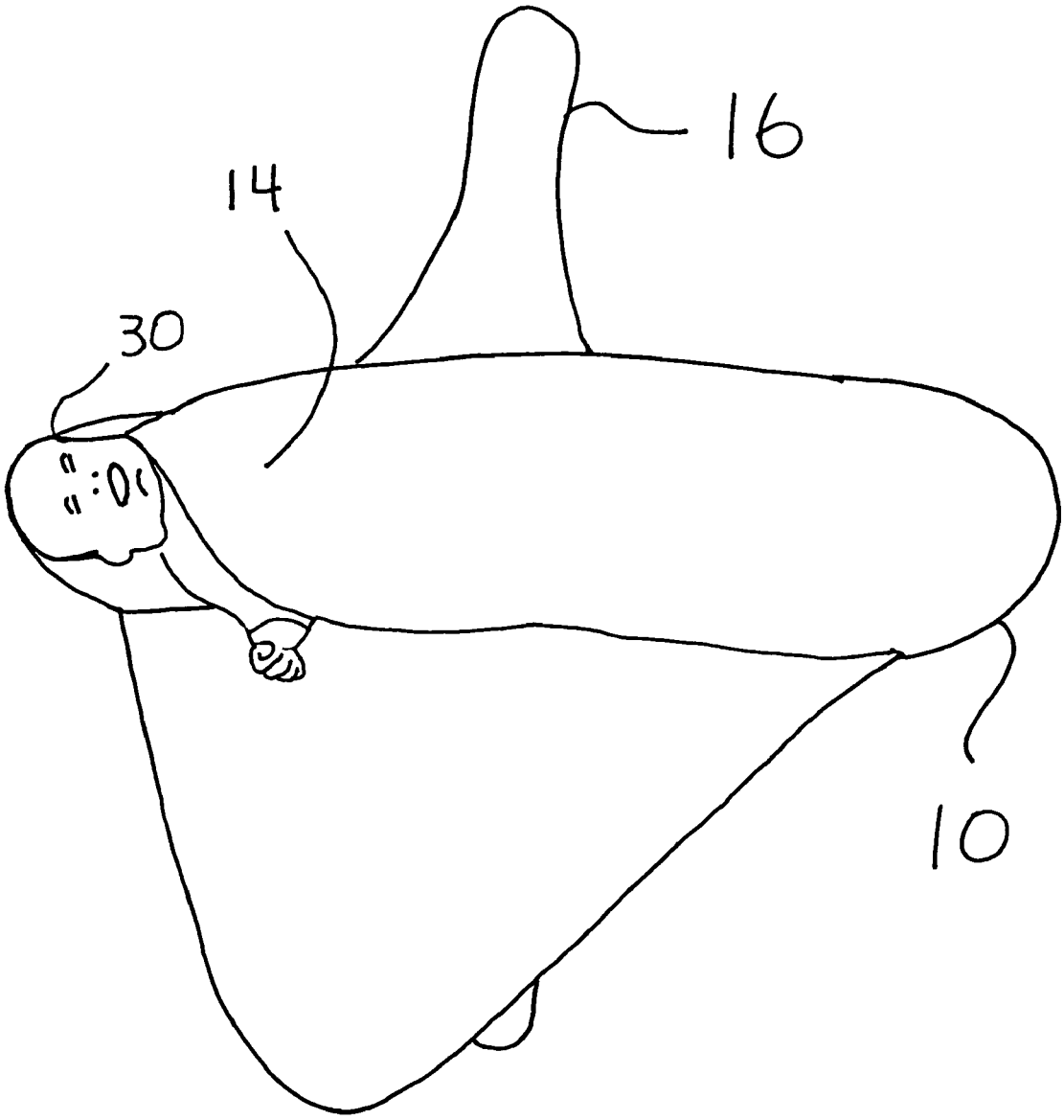
FIG. 6 is a front view of blanket with an infant lying on Section One, with Section Three tucked around the infant.
Figure 7:
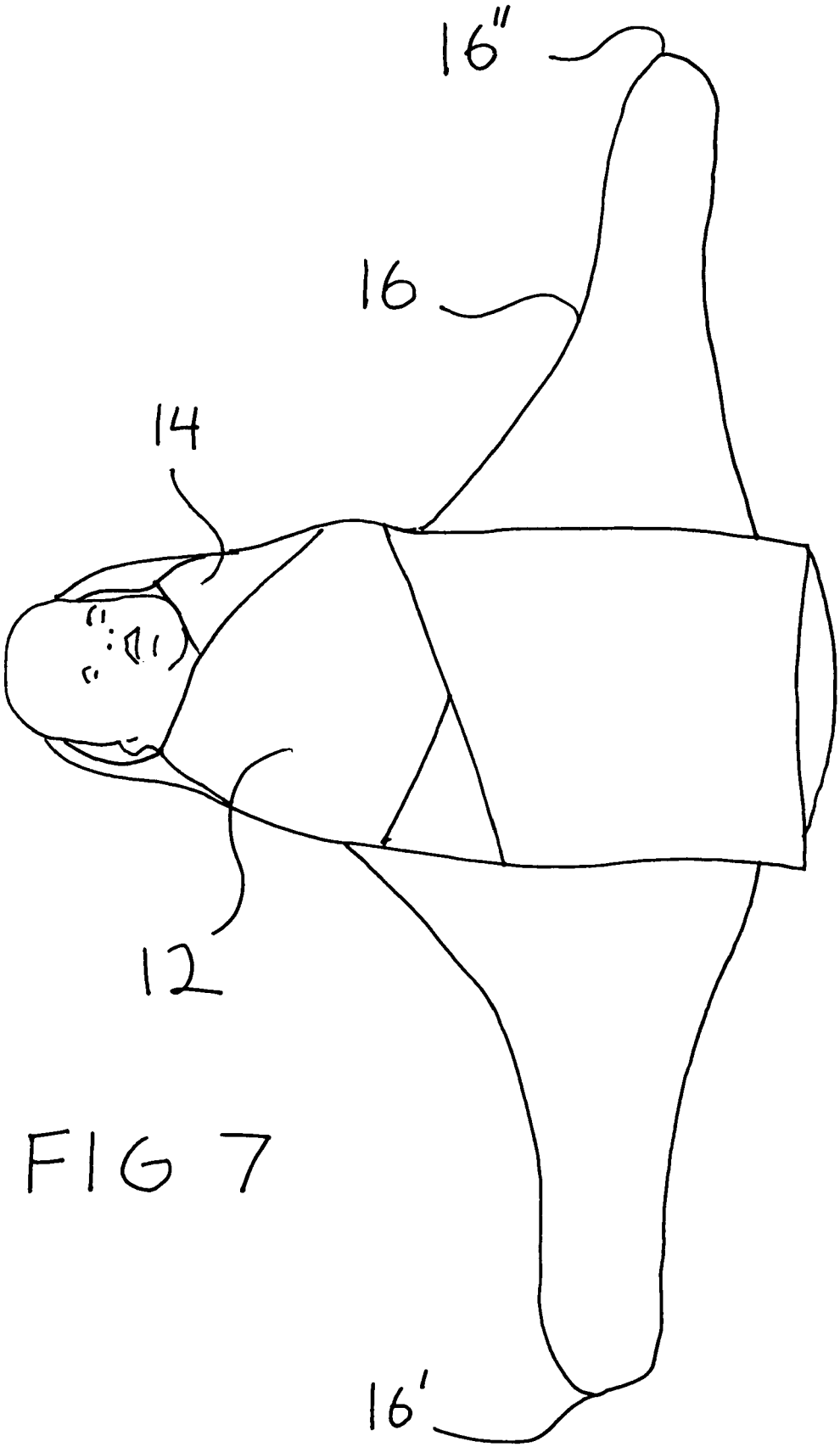
FIG. 7 is a front view of the blanket with an infant, with sections Two and Three tucked around the infant and Section Four lying flat.
Figure 8:
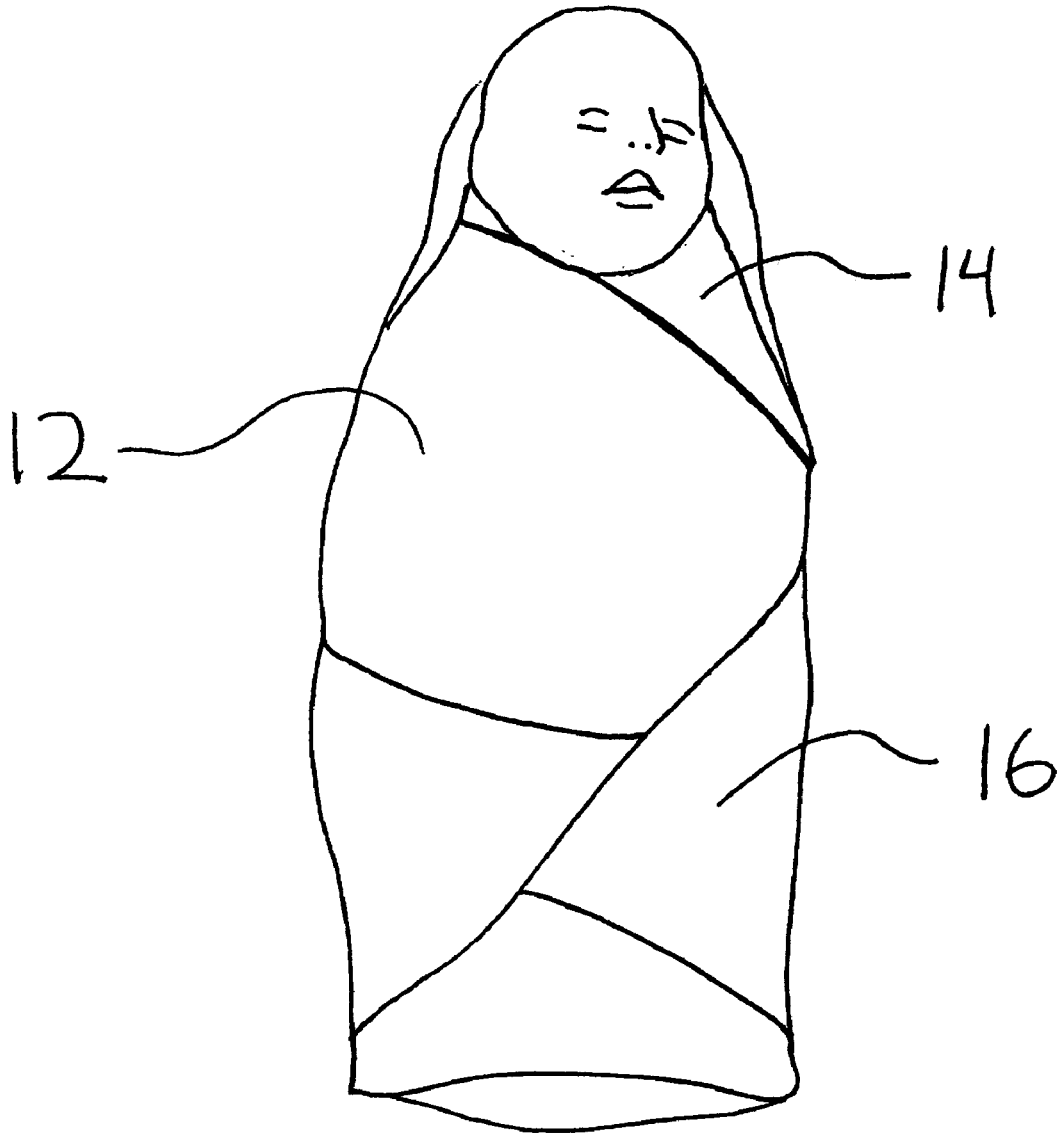
FIG. 8 is a front view of the blanket with an infant securely wrapped or "tucked" utilizing Section Four.
Figure 9:
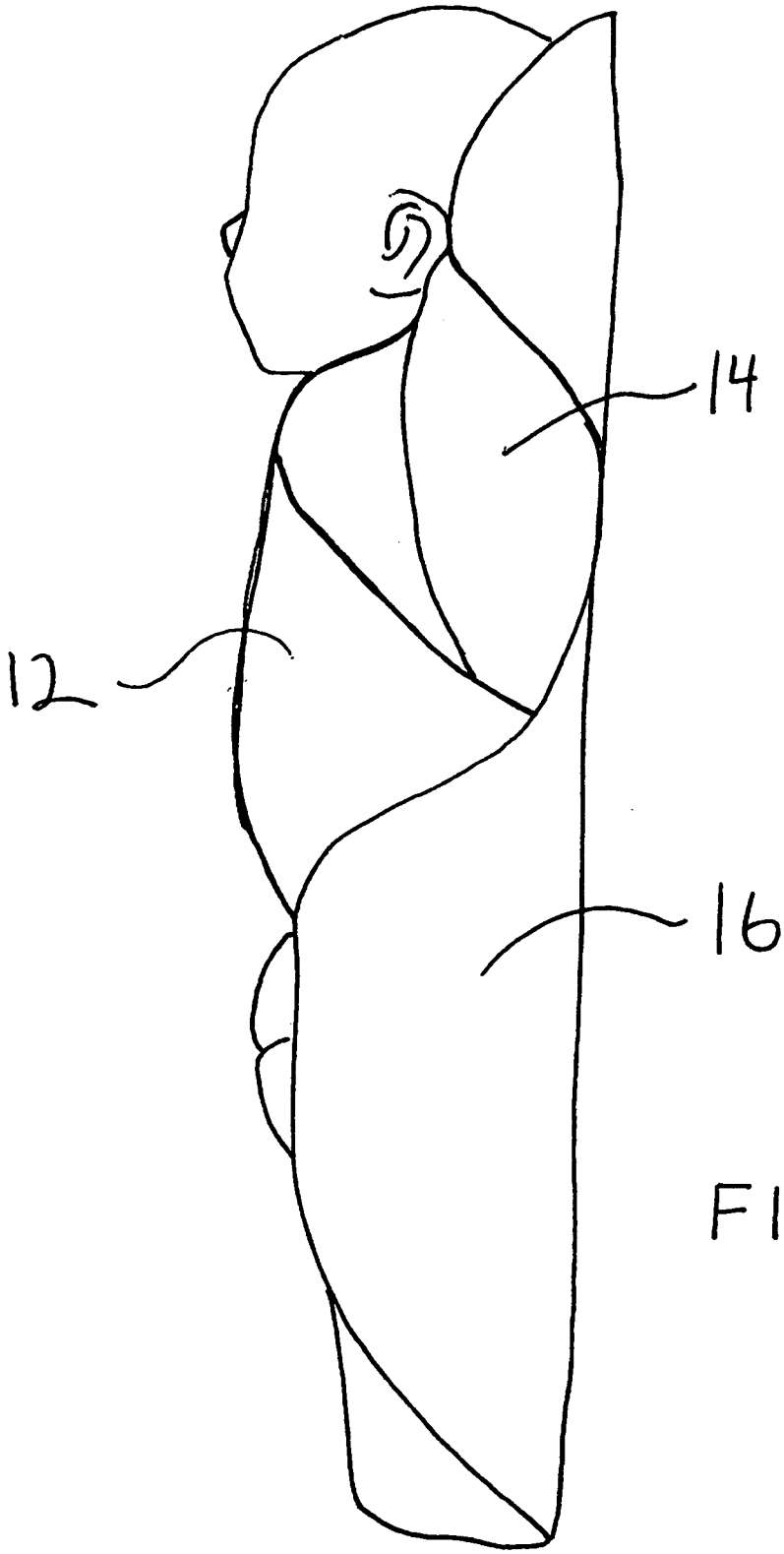
FIG. 9 is a side view of the blanket with an infant tightly and securely wrapped.
Figure 10:
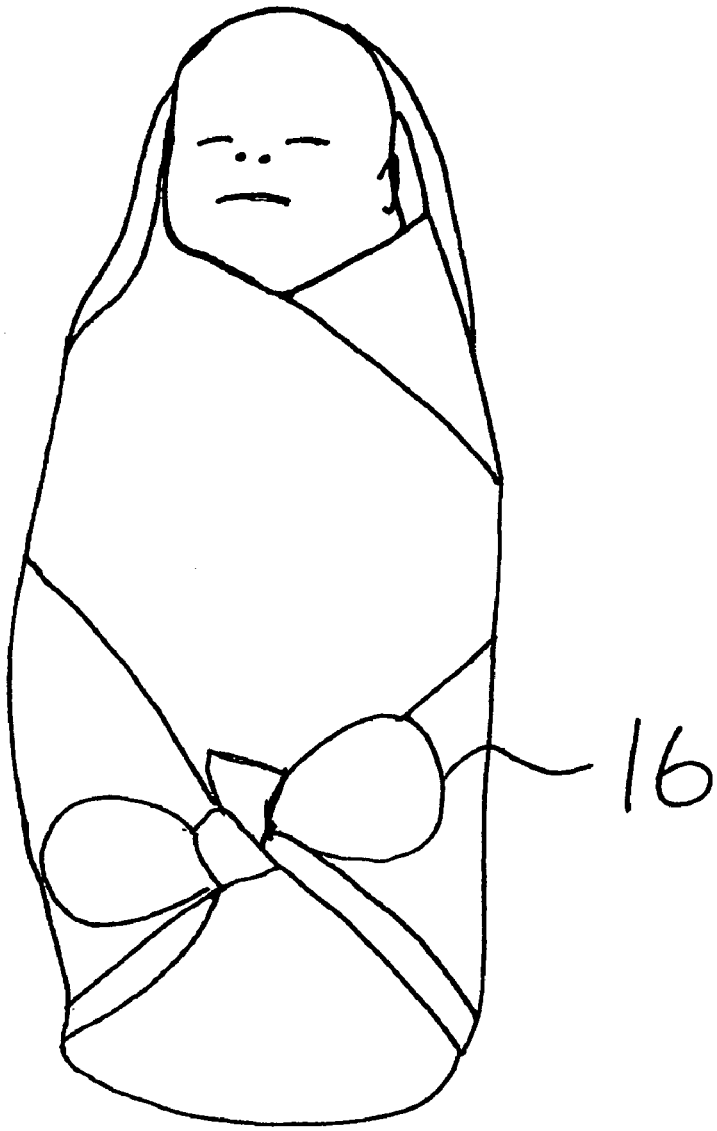
FIG. 10 is a front view of the blanket with an infant, showing Section Four tied securely.
Figure 11:
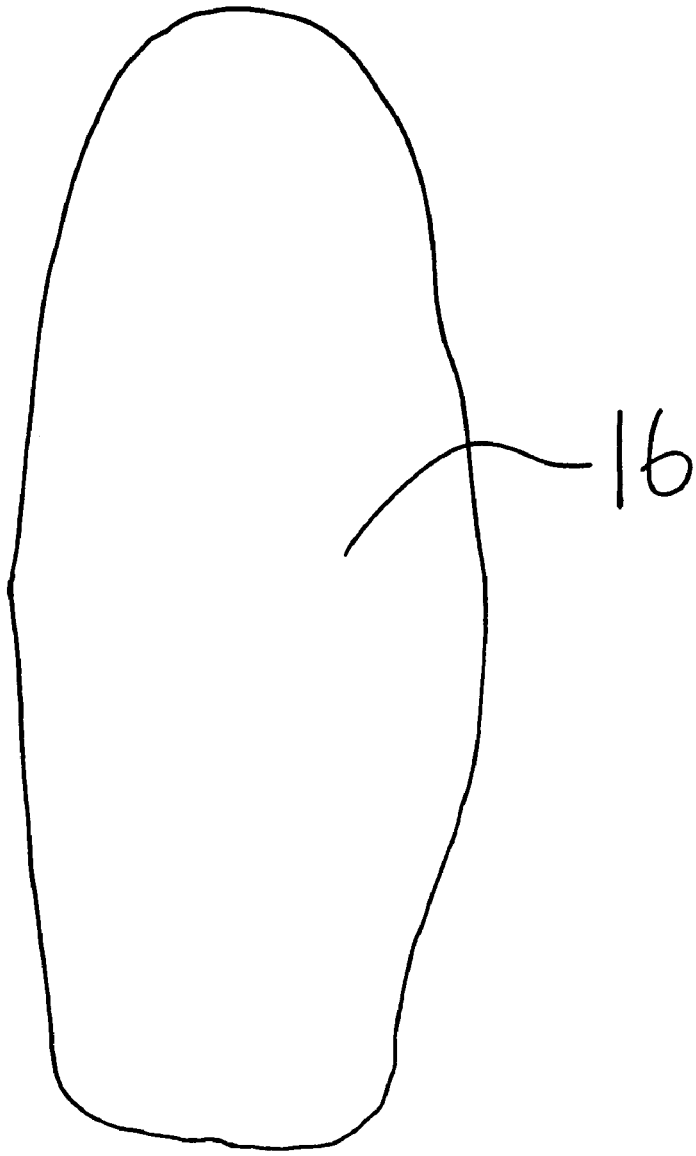
FIG. 11 is a back view of the blanket with the infant, tightly and securely wrapped.
Figure 12:
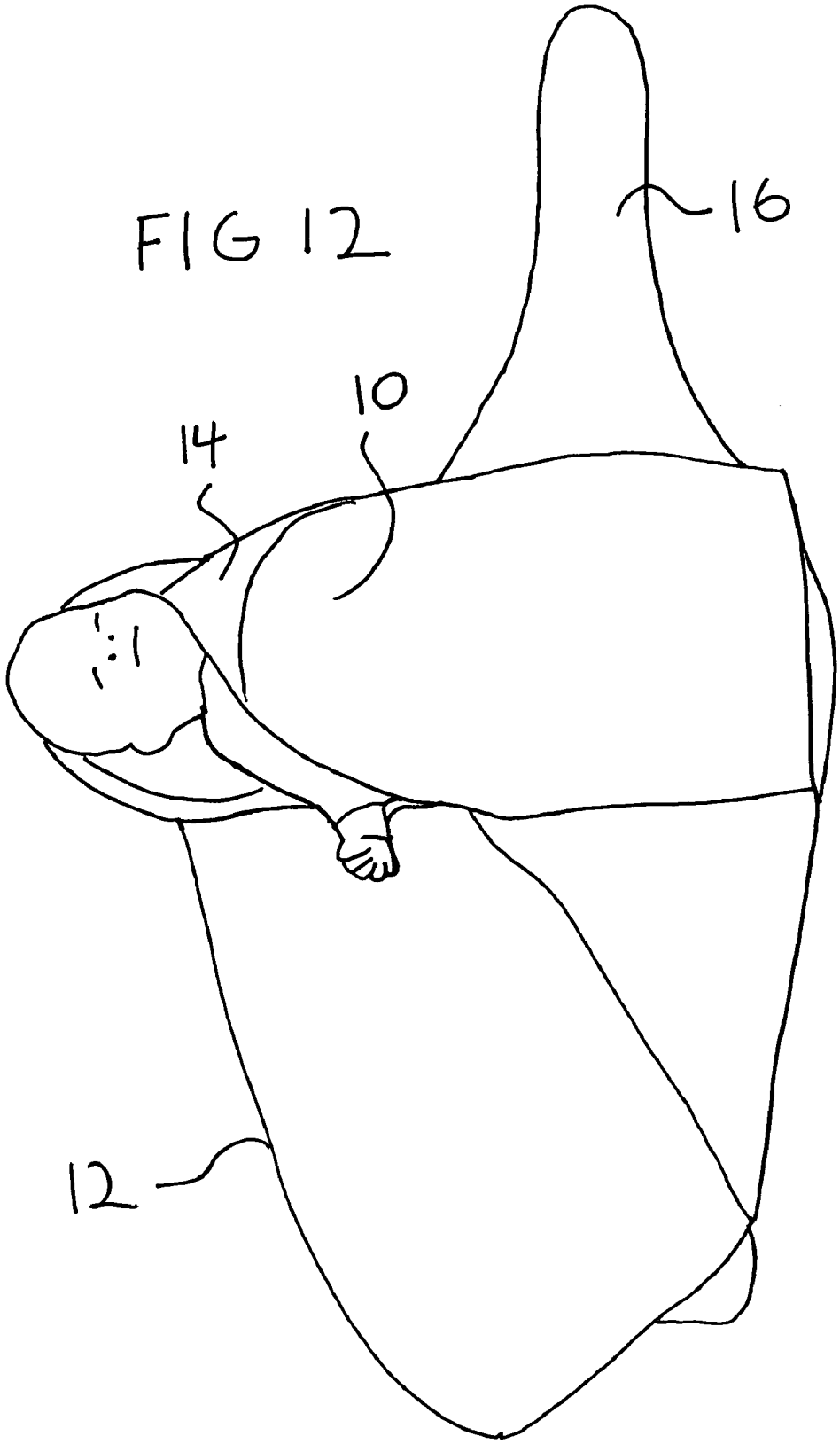
FIG. 12 is a front view of the blanket with an infant, with Section Two pulled across the infant and Section One pulled upwards towards the infant.

Additional views of embodiments of the invention are shown in FIGS. 4–12. FIG. 4 is front view of the blanket showing elements 10, 12, 14 and 16. FIG. 5 is a back perspective view of the blanket showing elements 10, 12, 14 and 16. FIG. 6 is a front view of blanket with an infant 30 lying on Section One, with Section Three tucked around the infant. The opening is located between the two fabrics where the wings and flaps can be tucked under baby's lower back or bottom, as discussed above. This opening is one of the key components of the invention to provide a means for optimizing fabric tension and using the baby's weight to keep the blanket wrapped snug and secure to prevent unraveling. Referring back to FIG. 2, this opening is formed by attaching section Two from point 2 to section One at point 1 and point 4 to point 3, while leaving a place along the length from points 2 to 4 unsown to the length from point 1 to point 3. This same sewing procedure can be used to create an opening between Section One and Section Three. FIG. 7 is a front view of the blanket with an infant, with Section Three tucked around the infant and Section Four lying flat. FIG. 8 is a front view of the blanket with an infant securely wrapped or "tucked" utilizing Section Four. FIG. 9 is a side view of the blanket with an infant tightly and securely wrapped. FIG. 10 is a front view of the blanket with an infant, showing Section Four tied securely. FIG. 11 is a back view of the blanket with the infant, tightly and securely wrapped. FIG. 12 is a front view of the blanket with an infant, with Section Two pulled across the infant and Section One pulled upwards towards the infant. Accordingly, an embodiment of the present swaddling blanket comprises a front central panel (10) having a front side, a rear side, a top edge, a bottom edge, a first elongated side (1 to 3), and a second elongated side (5 to 7); a first side panel (12) having a first wide end (2 to 4), and a first narrow end (9), wherein said first wide end is attached to said first elongated side of said front central panel; a second side panel (14) having a second wide end (6 to 8), and a second narrow end (11), wherein said second wide end is attached to said second elongated side of said front central panel, wherein said first side panel and said second side panel are about symmetrical with respect to an imaginary center line drawn from said top edge to said bottom edge; at least one opening selected from the group consisting of a first opening located between said central panel and said first side panel and a second opening located between said central panel and said second side panel, wherein said first wide end is attached to said first elongated side of said front central panel at first location and a second location, but is not continuously attached from said first location to said second location to form said first opening, wherein said second wide end is attached to said second elongated side of said front central panel at a third location and a fourth location, but is not continuously attached from said third location to said fourth location to form said second opening; and a rear panel (16) attached to said rear side, wherein said rear panel comprises a first extension (16') and a second extension (16") for securing said front central panel and said first side panel and said second side panel once said front central panel and said first side panel and said second side panel have been wrapped around a baby.

A procedure for using the swaddle blanket is as follows: Spread the blanket and place the baby in the middle, up high, with his head touching the top edge. Pull the left side of the blanket snugly across the baby's body. Make sure the baby's right arm is wrapped close to his body. Securely tuck the blanket under his lower back as close to his bottom as possible. Bring the bottom of the blanket up and fold the edge over as much as needed to adjust for size. As the baby grows, less will be folded. The right corner of the blanket is then pulled across the baby's body, securing his left arm near his body and tucking the blanket under the baby's bottom. There will be two remaining flaps. Use these for a more secure bundle by tucking the flaps under the baby's bottom between the two sides or tying the flaps to make a beautiful looking bow.

The invention is easy and fast to use. This reduces the frustration level felt by the person wrapping the infant. The swaddle method is easily achieved with each attempt; resulting in a warm wrap that looks like the traditional swaddle, is neat and secure, has no bulk or unnecessary fabric to deal with and is one piece. There are no fasteners or pockets. The blanket does not easily come loose, yet there are no restriction on growing infants chest. The invention allows for an infant's hands to be in or out of blanket with added security and snug fit around legs while still allowing for leg movement and growth. The present swaddle blanket is affordable and hugs and conforms to the baby's body.

The foregoing description of the invention has been presented for purposes of illustration and description and is not intended to be exhaustive or to limit the invention to the precise form disclosed. Many modifications and variations are possible in light of the above teaching. The embodiments disclosed were meant only to explain the principles of the invention and its practical application to thereby enable others skilled in the art to best use the invention in various embodiments and with various modifications suited to the particular use contemplated. The scope of the invention is to be defined by the following claims.

We claim:

1. A swaddling blanket, comprising:

a front central panel having a front side, a rear side, a top edge, a bottom edge, a first elongated side, and a second elongated side;

a first side panel having a first wide end, and a first narrow end, wherein said first wide end is attached to said first elongated side of said front central panel;

a second side panel having a second wide end, and a second narrow end, wherein said second wide end is attached to said second elongated side of said front central panel, wherein said first side panel and said second side panel are about symmetrical with respect to an imaginary center line drawn from said top edge to said bottom edge;

at least one opening selected from the group consisting of a first opening located between said central panel and said first side panel and a second opening located between said central panel and said second side panel, wherein said first wide end is attached to said first elongated side of said front central panel at first location and a second location, but is not continuously attached from said first location to said second location to form said first opening, wherein said second wide end is attached to said second elongated side of said front central panel at a third location and a fourth location, but is not continuously attached from said third location to said fourth location to form said second opening; and a rear panel attached to said rear side, wherein said rear panel comprises a first extension and a second extension for securing said front central panel and said first side panel and said second side panel once said front central panel and said first side panel and said second side panel have been wrapped around a baby.

2. The blanket of claim 1, wherein said front central panel includes a reinforced head portion near said top edge.

3. The blanket of claim 1, comprising no zippers, no hook and loop fasteners, no snaps, no pockets and no buttons.

4. The blanket of claim 1, comprising single or double fabric.

* * * * *